United States Patent [19]

Traben

[11] 4,143,692

[45] Mar. 13, 1979

[54] METHOD FOR THE PRODUCTION OF TIMBER FROM ROUND LOGS

[75] Inventor: Josef Traben, Oberkirch, Baden, Fed. Rep. of Germany

[73] Assignee: Firma Gerbruder Linck Maschinenfabrik und Eisengiesserei, Oberkirch, Baden, Fed. Rep. of Germany

[21] Appl. No.: 760,660

[22] Filed: Jan. 19, 1977

Related U.S. Application Data

[62] Division of Ser. No. 607,298, Aug. 25, 1975, Pat. No. 4,086,944.

[30] Foreign Application Priority Data

Apr. 5, 1975 [DE] Fed. Rep. of Germany ..... 2514901

[51] Int. Cl.[2] ..... B27L 9/00

[52] U.S. Cl. ..... 144/323; 83/874; 83/404.4; 83/425.3; 83/433; 83/599; 83/647.5; 144/3 P; 144/159; 144/184

[58] Field of Search ..... 144/2 R, 3 R, 3 P, 41, 144/44, 5 S, 17 S, 120, 114 R, 115, 132, 159, 162 R, 193 R, 211, 309 R, 309 L, 314 R, 315 R, 316, 319, 209 R, 3 K, 326 R, 323, 164, 165, 185, 208 E; 83/4, 433, 407, 404.4, 425.2, 426, 433, 599, 647.5, 788

[56] References Cited

U.S. PATENT DOCUMENTS

| | | | |
|---|---|---|---|
| 1,503,784 | 8/1924 | Dumont | 144/184 |
| 1,539,603 | 5/1925 | Saprones | 144/208 E |
| 3,998,252 | 12/1976 | Senba | 144/184 X |

*Primary Examiner*—Othell M. Simpson
*Assistant Examiner*—W. D. Bray
*Attorney, Agent, or Firm*—Schmidt, Johnson, Hovey & Williams

[57] ABSTRACT

A method and apparatus for processing round logs in which substantially the entire log is utilized to produce a relatively high value wood stock. The outer area of the log is peeled in sheets to square the central area for the formation of planks, beams, boards or the like while the peeled sheets may be dried, graded, cut to size and joined together and glued to form strips of any desired length and width which, in turn, may be glued in layers to form panels or other high value components. A plurality of powered, adjustable peeling knives are arranged in opposed sets to machine the log as it is caused to pass thereby on a conveyor. In one form of the invention the knives are driven to undergo a circular oscillatory motion while a second embodiment discloses a knife drive in which the knives are guided in vibratory movement. A third form of drive permits a drawcut in that the peeling knives are drive in a longitudinal direction relative to their cutting edges.

1 Claim, 25 Drawing Figures

5
6
6
6.1
8
VI
VI 6
8.2
8

6
VII
VII
8.2
6.1
8
7.1
7

Fig.16
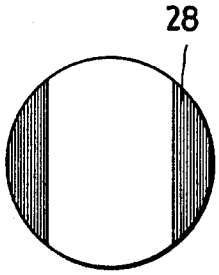
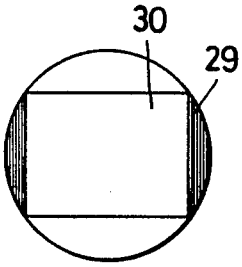
Fig.17
Fig.18
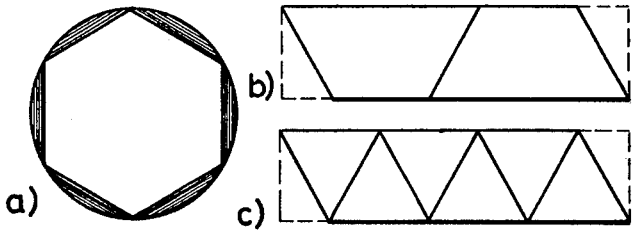
Fig.19
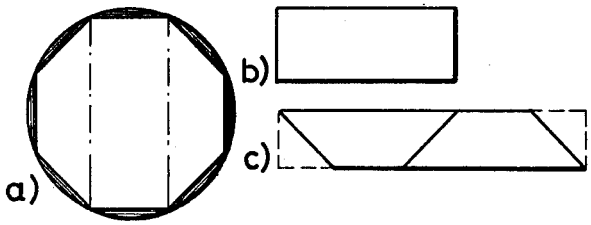

METHOD FOR THE PRODUCTION OF TIMBER FROM ROUND LOGS

This is a division of application Ser. No. 607,298 filed on Aug. 25, 1975 now Pat. No. 4,086,944.

This invention relates to a method for producing commercial timber from round logs, the central area of the log being machined into squared timber, and also to an apparatus for carrying out the method.

In the case of the method for the production of squared timber known as "profile chip-cutting," the segments of wood lying at the side, i.e., outside the squared timber, are broken up into usable chips by rotating knife heads, for example for the manufacture of chipboard or of cellulose (German Pat. No. 1,403,686). The economic profitability of the method is due essentially to the fact that the whole log is divided up into usable timber practically without waste, since no low-value slabs, sawdust or chippings and wood shavings of insufficient size are formed. It must be borne in mind here, however, that the value of the chips or shavings produced per unit volume of the wood being machined is substantially less than in the case of the squared timber which is produced and which is machined to form planks, beams, board and the like. Also, the known method is only economically practicable if the chippings or shavings produced can be transported to the location of further processing without excessive transportation coats. High transportation costs cannot be borne economically on account of the relatively low value of the wood in this form.

It is therefore the object of the invention to devise a method of the type mentioned at the outset such that with relatively low cost there can be produced from the lateral wood segments, lying outside the squared timber to be produced, a high-value product which is close to the squared timber as regards its value per unit volume, so that there is possible a complete division of the round log into high value wood products whose transportation even to a more remote processing location is economically supportable.

This object is achieved in accordance with the invention in that during advancement of the round log in its longitudinal direction the wood segments lying outside the squared timber to be produced are divided by peeling knives arranged in groups into several layers of peeled sheets.

The peeled sheets thus formed may be dried, graded, cut to size, joined together and glued to form strips of any desired length and width. These strips may be separated and glued in layers to form panels or be further processed to form other high value components of high strength. As a result, there is a substantial increase in the cubic utilization factor, since squared timbers (prisms) and peeled sheets are produced at the same time in one integrated operation.

Advantageously, the method is performed in such a way that during a first pass of the log two wood segments lying opposite one another are divided up into peeled sheets and that during at least one further pass after a rotation of the module thus produced two further wood segments lying opposite one another are divided up into peeled sheets. In this way, with relatively low labor costs and with a simple design of processing machine there is produced from a round log a squared timber of any desired number of straight edges, the desired number of edges determining the number of passes necessary inasmuch as for producing a quadrilateral shape two passes are necessary, for producing a hexagon three passes, etc.

An advantageous development of the inventive idea is provided in that the timber may be produced with more than four sides and is then cut by sawing into squared timbers with triangular or trapeziform cross-section, optionally in addition to squared timbers of rectangular cross-section, which can be glued together to form boards, beams, planks or the like. As a result it is possible with a high throughput rate, for example with feed speeds of 50 meters per minute, at the same time to increase the cubic utilization of the wood for example by 30%, since almost all the volume of wood is machined into peeled sheets and rectangular or polygonal prisms, which can in turn be glued to form boards. This is not possible with the sawmill technology known hitherto.

This essential increase in the utilization of the wood is of particular importance in view of the scarcity of raw materials, which will become greater and greater in the future. In accordance with the method of the invention boards of any desired width and relatively great thickness can be produced from relatively thin and low-value round timber, it also being perfectly possible to produce multilayer panels. In this case there are obtained building elements of plywood-like construction and with particularly favorable strength properties.

A particularly advantageous apparatus for carrying out the method, with a conveying and feeding device holding the round log or module and moving it in its longitudinal direction and with at least one machining device, is characterized in that several peeling knives are provided on the machining device, staggered one behind the other in the feed direction. In this way, with a single apparatus and at a single machining point the round log is divided up directly into the desired number of peeled sheets and into the squared timber to be produced, without any further cutting of the wood segments removed from the square timber being necessary in order to obtain the peeled sheets.

The peeling knives are advantageously adjustable transversely to the feed direction, so that the number and/or thickness of the peeled sheets produced can be varied.

The peeling knives may be arranged in the machining device rigid with the chassis thereof; in this case the construction of the machining device is particularly simple. In order to reduce the advancement forces, however, the peeling knives may also be movable by a drive means and may for example undergo an oscillatory movement, which in the simple case may be a circular oscillatory movement. It is also possible for the peeling knives to be guided in a vibratory movement. In order to obtain a drawcut, the peeling knives may be moved in the longitudinal direction of their cutting edges. In order to partially relieve the feed drive of the cutting forces and to transfer the generation of the cutting forces at least partially into the drive for the peeling knives, the peeling knives may, in a further development of the inventive idea, be arranged in such a way that they are moved in a direction inclined to the longitudinal direction of their cutting edges. The peeling knives may be driven mechanically, pneumatically, hydraulically or magnetically.

In order to divide up a round log in a single pass into a squared timber with four or more sides and into a greater number of strip-like peeled sheets, it may in still another development of the inventive idea be provided that the machining device has several groups of peeling knives arranged one behind the other in the feed direction. When the log has passed through the peeling knife groups arranged one behind the other it has been machined on all sides in a single pass, it having been rotated between the individual stations.

The invention will be described in greater detail below on the basis of examples of embodiment which are illustrated in the drawings as follows.

Figure 4:
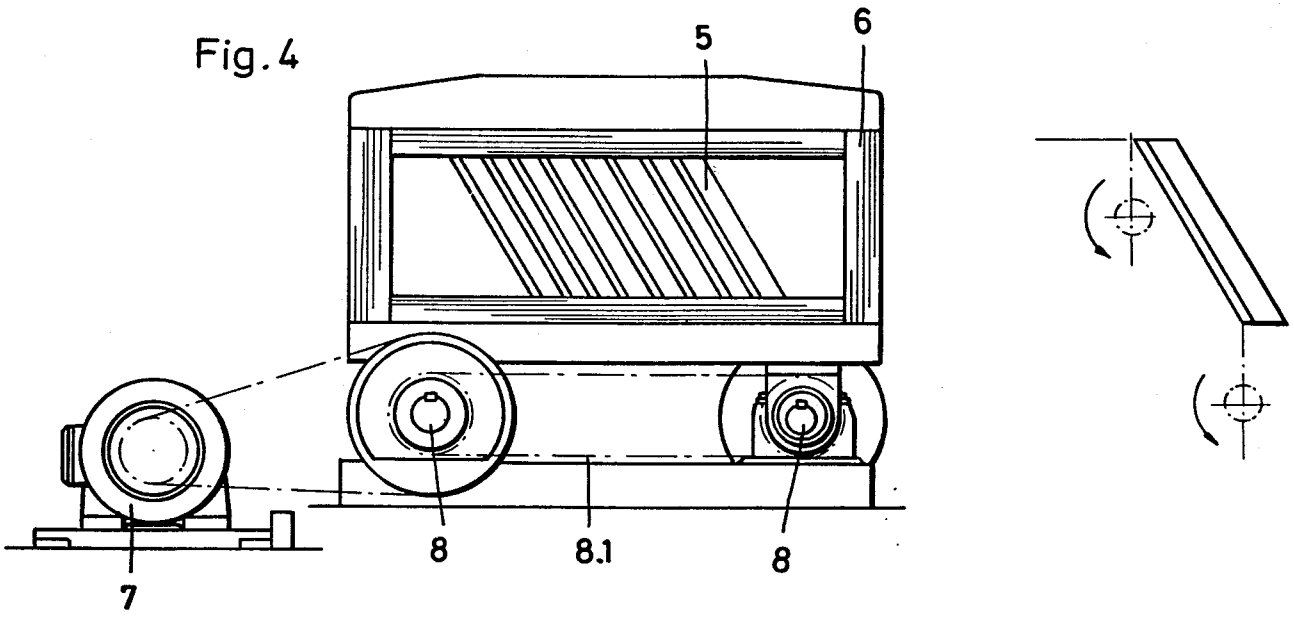

FIGS. *3a–c* are possible modes of drive for the peeling knives, in simplified representation;

FIG. 4 is a simplified side view of the drive device for a knife movement as in FIG. *3c;*

Figures 5, 6, 7:
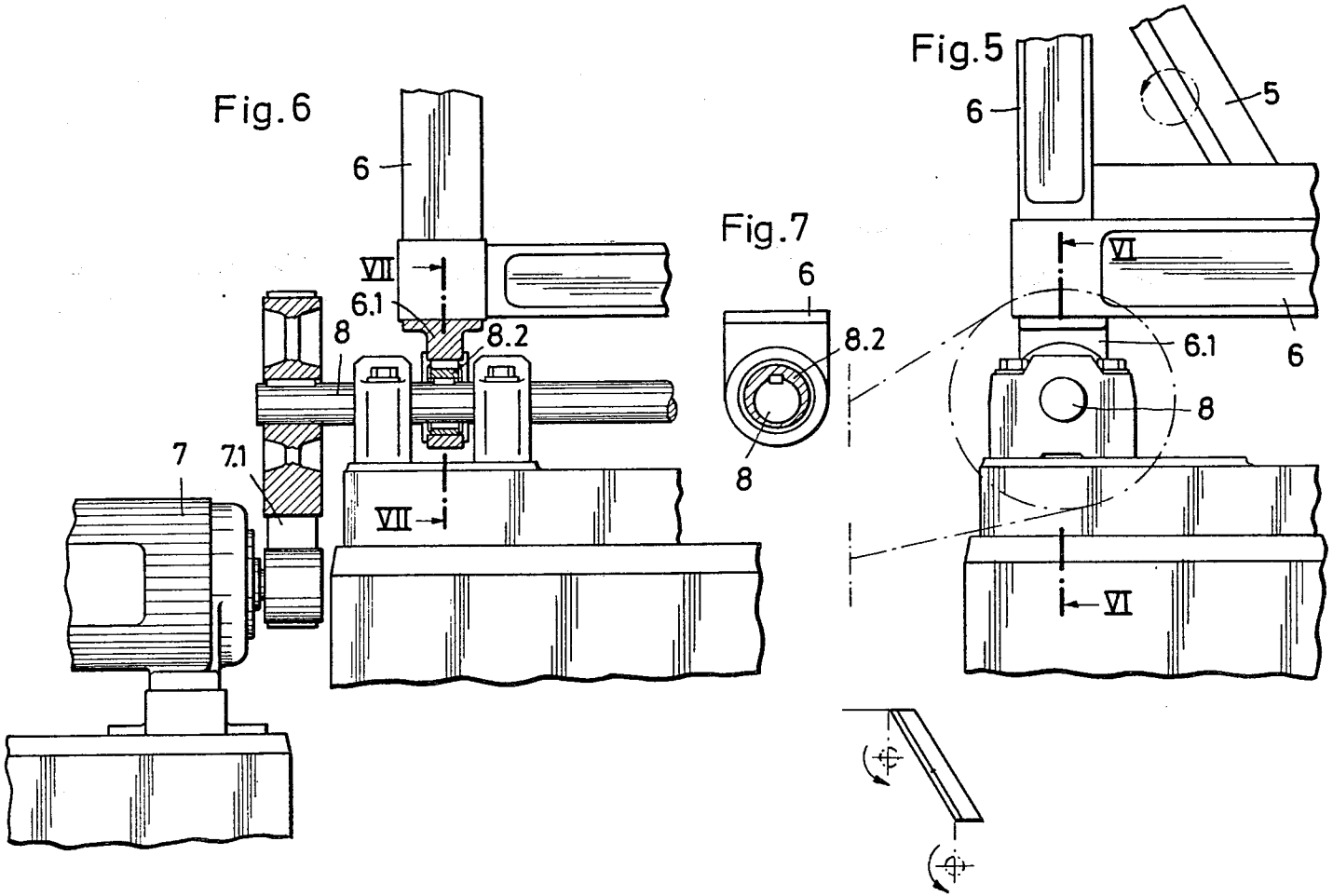
Figure 8:
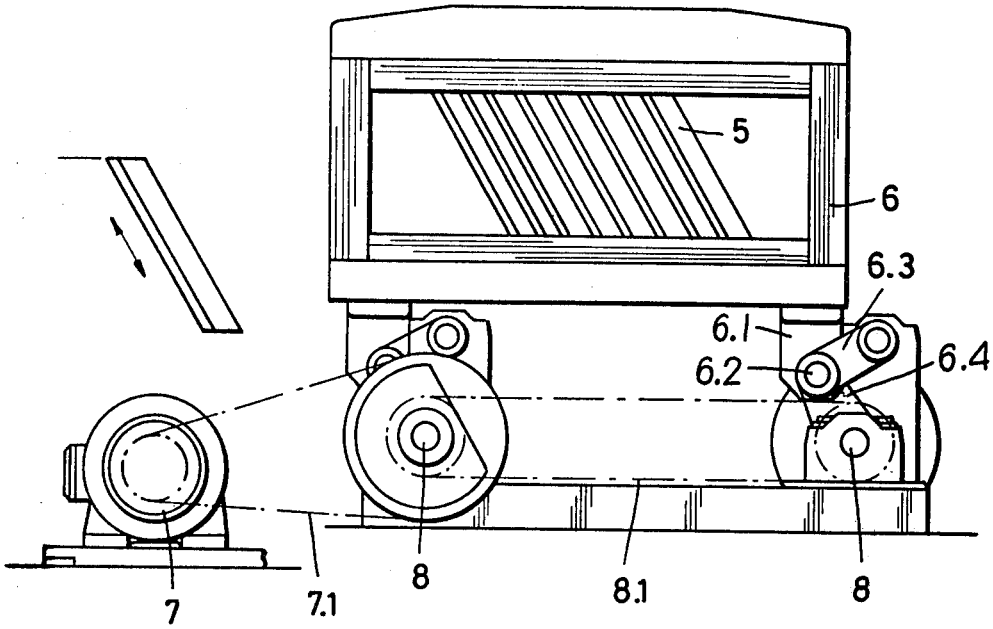

FIG. 5 is an enlarged partial representation of the drive mounting of the knife frame as shown in FIG. 4;

FIG. 6 is a section along the line VI—VI of FIG. 5;

FIG. 7 is a section along the line VII—VII of FIG. 6;

FIG. 8 is a simplified side view of the drive device for a knife movement as in FIG. *3a;*

Figure 9:
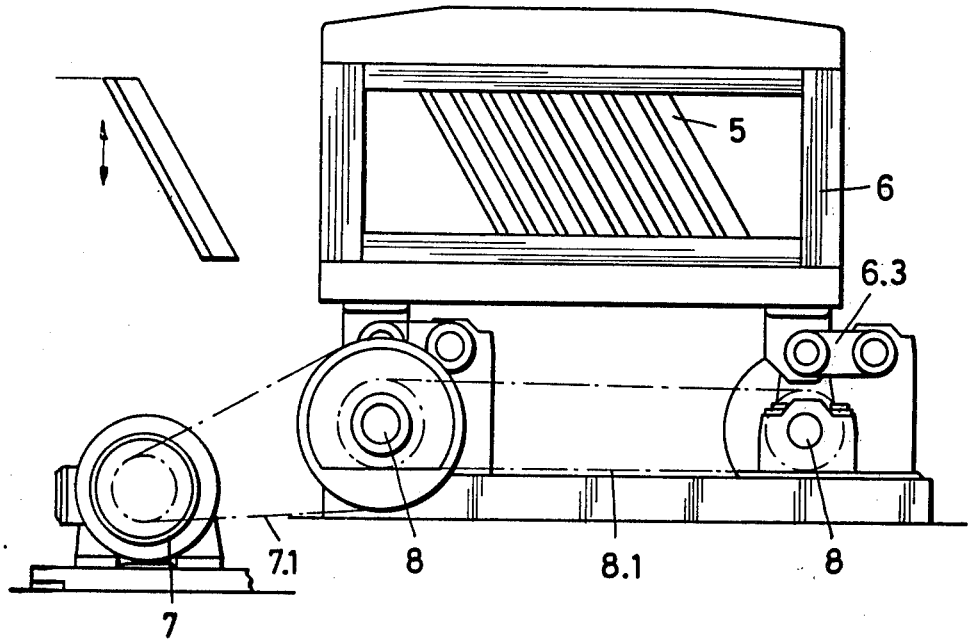

FIG. 9 is a simplified side view of the drive device for the knife movement as shown in FIG. *3b;*

Figure 1:
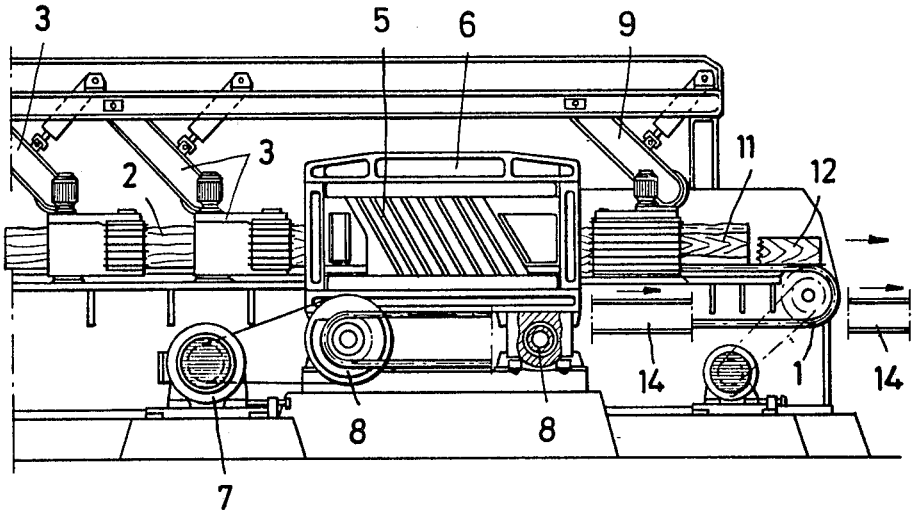
FIG. 1 is a side view of an apparatus for producing squared timbers and peeled sheets from round logs.
Figure 2:
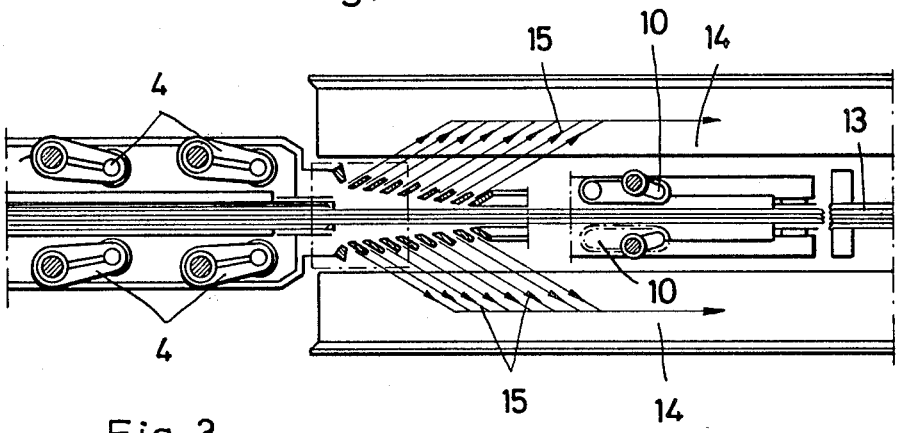
FIG. 2 is a plan view of the apparatus shown in FIG. 1, the peeling knives being shown in section and the upper parts of the machine and also the log having been omitted.
Figure 3:
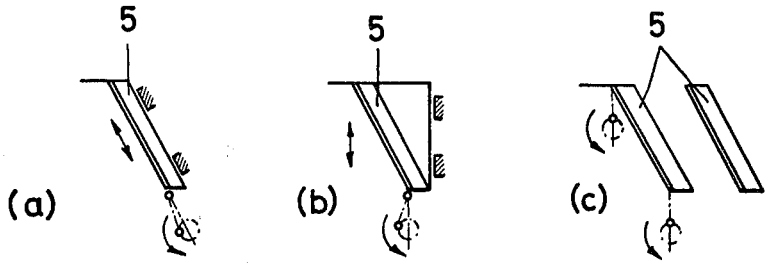
Figures 10, 11, 12:
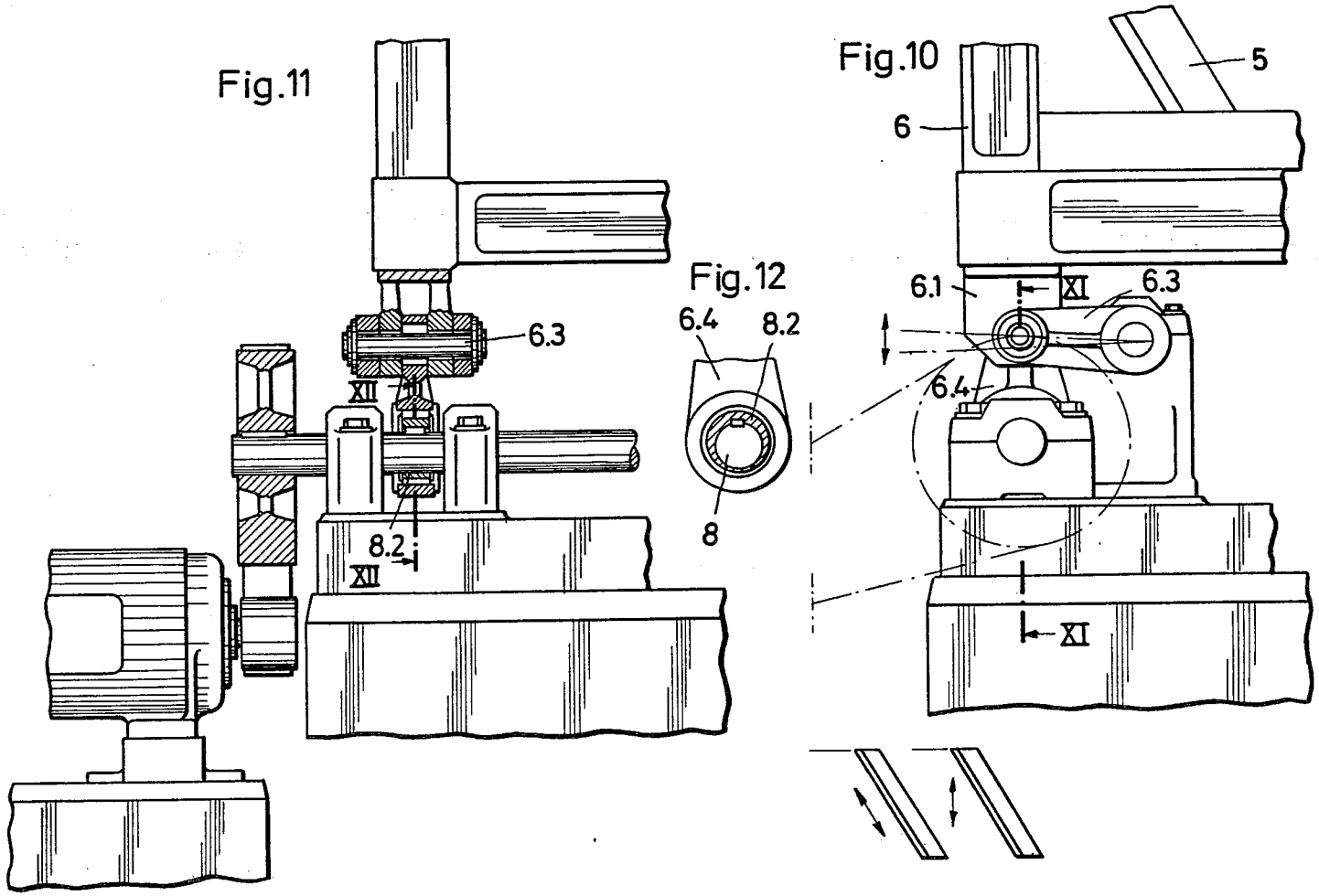
Figure 13:
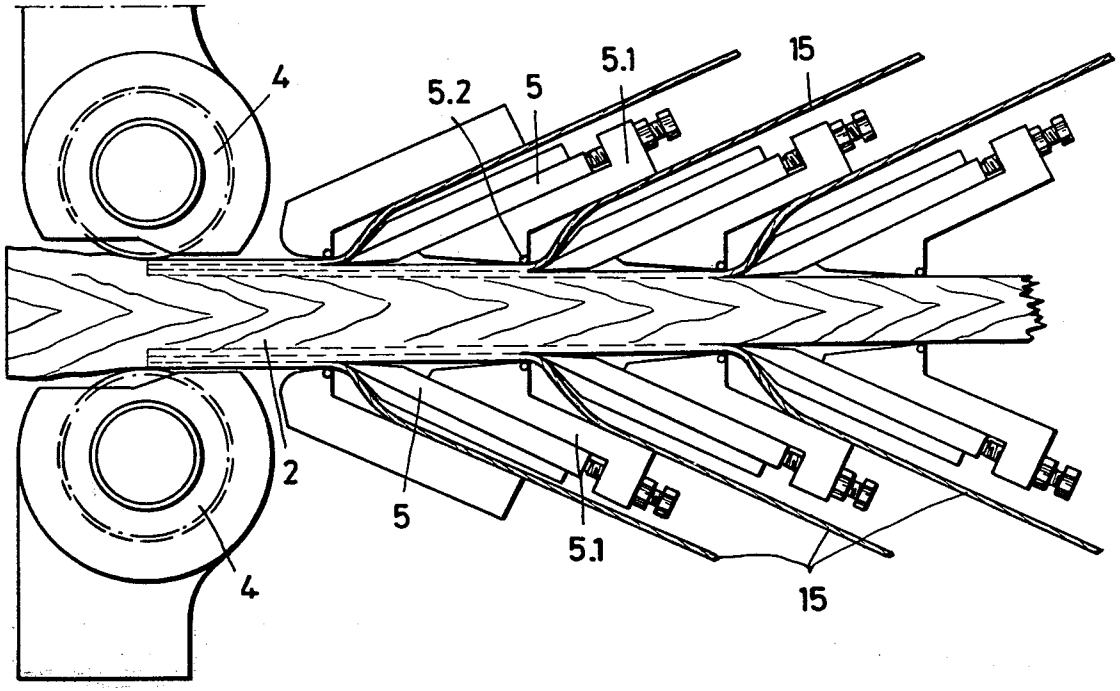
Figure 14:
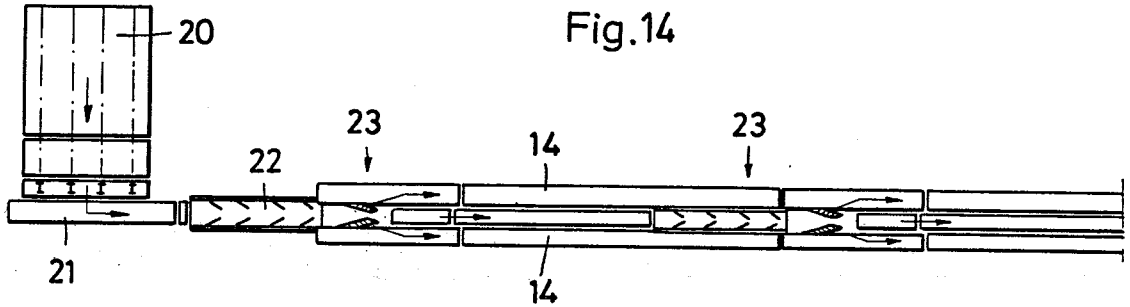
Figure 15:
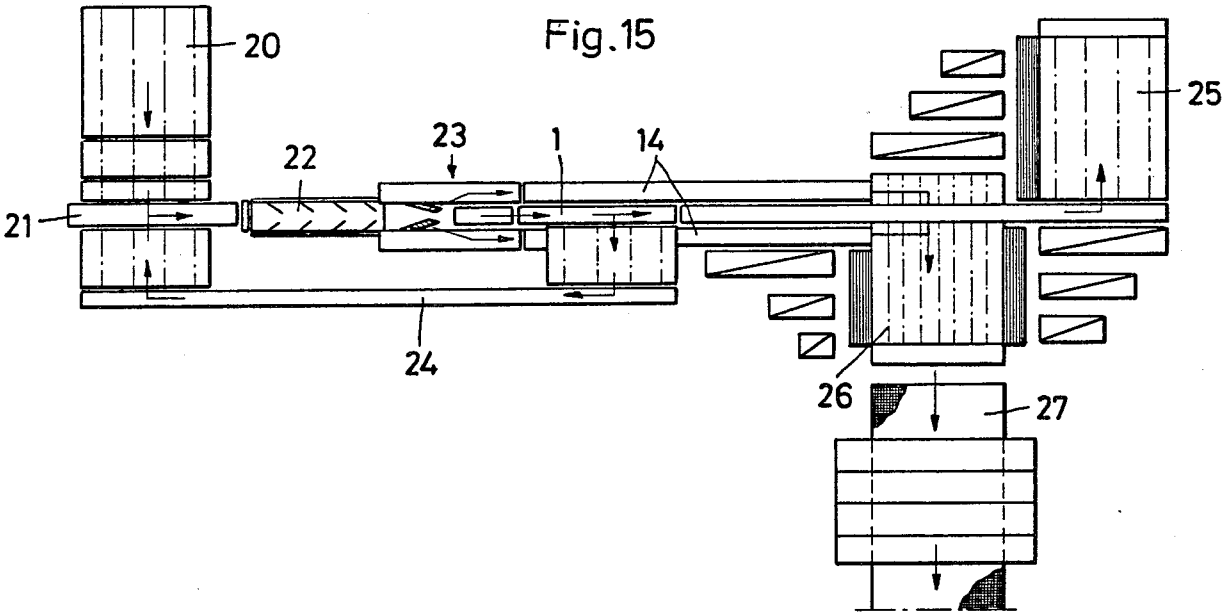

FIG. 10 is a simplified partial representation of the drive mounting of the knife frame as shown in FIG. 9;

FIG. 11 is a section along the line XI—XI of FIG. 10;

FIG. 12 is a section along the line XI—XI of FIG. 11;

FIG. 13 is an enlarged plan view of the tools in the machining area of the apparatus as shown in FIGS. 1 and 2;

FIG. 14 is a machining unit with two machining devices as shown in FIGS. 1 and 2 arranged one behind the other;

FIG. 15 is a machining unit with a machining device as shown in FIGS. 1 and 2 and a conveyor device for returning the modules after the first pass;

FIG. 16 is a cross-sectional view through a round log, with the two wood segments machined in the first pass;

FIG. 17 illustrates the wood segments machined in the second pass, a squared timber of rectangular cross-section having been produced;

FIG. 18*a* is a cross-sectional view of a round log which is machined to a hexagon;

FIGS. 18*b* and 18*c* illustrate prisms of trapeziform or triangular cross-section produced by cutting the hexagon as in FIG. 18*a*, which prisms are glued to form boards;

FIG. 19*a* illustrates in cross-section a round log which is machined to an octagon; and FIGS. 19*b* and 19*c* illustrate a rectangular prism and prisms of trapeziform cross-section which are produced by cutting the octagon as in FIG. 19*a* and which are glued to form a board.

The machining device illustrated in FIGS. 1 and 2 has a driven chain bed 1 on which the round log 2 is conveyed. The log 2 is pressed onto the chain bed 1 by holding devices 3; driven centering devices 4 hold the log laterally and feed it to two obliquely staggered peeling knives 5 which are arranged opposite one another and which in the case of the example of embodiment shown in FIG. 1 are each arranged in a common frame 6 which is mounted on two eccentric shafts 8, which are driven by a motor 7 and which impart a circular oscillatory movement to the frame and to the peeling knives 5 held therein. The knives 5 are set at an angle and staggered in such a way that the round log, which in FIGS. 1 and 2 travels from left-to-right, first of all arrives between the peeling knives which are farthest apart and then travels towards the peeling knives lying closer together.

A holding device 9 and driven lateral centering devices 10 form together with the chain bed 1 the extraction means for the machined wood, which is for example, in the form of a module 11 or of a squared timber 12 (FIG. 1). A conveyor device 13 transports the machined wood away.

On both sides of the machining device there are provided conveyor belts 14, which remove the peeled sheets 15 produced (FIG. 2) for further processing.

In order to keep the feed forces as small as possible, to avoid splits being formed into the wood, to obtain surfaces as smooth as possible and to make possible a good adaptation to the structure of the wood in each case, the peeling knives 5 undergo an oscillatory movement. FIG. *3a* shows schematically a crank drive for a peeling knife movement in the longitudinal direction of the knife edge; in this way there is obtained a drawcut. If the stroke imparted by the crank drive is at an angle to the peeling knife edge (FIG. *3b*), then the knife drive also applies much of the cutting force during the downward movement, so that the feed drive is relieved. In the case of the double crank drive in accordance with FIG. *3c*, the peeling knives 5 undergo a circular oscillatory movement.

Details of possible drive devices for the knife movement are shown in FIGS. 4 to 12, the direction of movement of the knife obtained therewith being shown schematically in each case. In all the embodiments illustrated, the motor 7 drives, by way of a belt drive 7.1, the eccentric shafts 8, which are synchronized with one another by way of a chain drive 8.1. Eccentrics 8.2 are keyed onto the shafts 8.

In the case of the embodiment in accordance with FIGS. 4 to 7, which corresponds to the drive shown in FIG. 1, the eccentrics 8.2 run in each case in the bore of a bearing block 6.1 connected to the knife frame 6. In the case of this arrangement, each point of the knife frame 6 and thus also every point of the knives 5 undergoes a circular movement, as indicated in FIG. 5.

In the embodiments shown in FIGS. 8 and 9, the bearing blocks 6.1 rigidly connected to the knife frame 6 articulately connected by way of a pin 6.2 both to a swing lever 6.3 pivotally mounted on the chassis of the machine and to a push rod 6.4 in the bore of which runs the eccentric 8.2. When the swing levers 6.3 are horizontal (FIGS. 9 and 10), the knife frame 6 undergoes an essentially vertical oscillatory movement, which in the case of oblique knives 5 leads to a chopping action. By adjustment of the eccentrics 8.2 and of the swing levers 6.3, any desired oscillatory knife movement at any angle of inclination can be obtained. A combination of chopping and oscillation is possible. If the swing levers 6.3 are set at such an angle of inclination that they lie essentially perpendicular to the longitudinal direction of the knives, then there is obtained the oscillatory knife movement in the longitudinal direction of the cutting edge, as shown in FIG. *3a*.

FIG. 13 shows the arrangement of the peeling knives in detail. In each case a peeling knife holder 5.1 carries a peeling knife 5 adjustable in the longitudinal direction and forms with a projection 5.2 a slide and backing edge for the peeled sheet 15 removed by the following peeling knife. This construction prevents the wedge split made by an adjacent peeling knife 5 from running too far in advance of the edge thereof and extending the split into the timber. At the same time, the wood is guided in the machining area by the edges 5.2.

FIGS. 14 and 15 show two different machines for handling round logs. In both cases, the logs are fed by way of a log separating device 20 to a feeding device 21, for example a chain belt or conveyor belt. From there the logs pass into an intake device 22 of a machining device 23 constructed for example in accordance with FIGS. 1 and 2.

In the case of the example of embodiment in accordance with FIG. 14, the module (log machined on two opposite sides) produced from the log is rotated through 90° about its longitudinal axis and is then machined on its two still unmachined sides in a second machining device 23 of basically the same construction.

In the case of the example of embodiment of the system in accordance with FIG. 15, the module leaves the chain bed 1 after passing through the machining device 23 and is returned to the feeding device 21 again on a return conveyor device 24, for example a conveyor belt. The module, lying on one of its machined surfaces, passes again through the machining device 23, so that there is produced a rectangular timber which, as in the case of the system in accordance with FIG. 14 (but not shown there), is delivered to a sorting and collecting device 25. The lateral conveyor belts 14 likewise bring the peeled sheets to a sorting and collecting device 26, from where the sheets are delivered to a device 27 where they are assembled into strips, sheets or the like and transported further.

In FIGS. 16 and 17 there is shown in simplified form how the lateral wood segments 28, 29 are machined one after another into peeled sheets during the manufacture of a rectangular timber 30. In the case of the manufacture of a hexagonal timber (FIG. 18*a*) the proportion of wood machined into peeled sheets is smaller; it becomes smaller still if a squared timber with an even greater number of sides is produced, for example, an octagon as in FIG. 19*a*. In FIGS. 18*a* and 19*a* there is indicated by chain lines how the polygon produced can be divided up by cutting. For example, the hexagon of FIG. 18*a* can be divided by one cut (vertical line in FIG. 18*a*) into two prisms of trapeziform cross-section, which can be glued together in the manner shown in FIG. 18*b* so as to form a panel. Panels of any desired width can be made from a number of such prisms, and these can in turn be glued one onto the other in order to form multilayer panels.

If the hexagonal cross-section of FIG. 18*a* or the octagonal cross-section of FIG. 19*a* are divided up by radial cuts into prisms of triangular cross-section, then these can be used to make panels of any desired width by gluing as in FIG. 18*c*.

In FIG. 19*a* it is also indicated that a prism of rectangular cross-section (19*b*) can first be cut from the middle part of the octagon. The remaining prisms of trapeziform cross-section may likewise be glued together to form a plate in the manner shown in FIG. 19*c*.

By comparing the cross-sectional representations in FIGS. 16 to 19 it can be seen that as the number of sides increases there is possible a better adaptation to the circular cross-section and thus a higher cubic utilization factor of the middle area up to the order of 80 to 95%. By gluing the peeled strips thus produced there can be produced from relatively thin round timber boards, planks, panels and the like of any desired size, optionally with a surface finish, in which case for example the peeled strips may also be used as covering veneers.

Prior to the peeling operation, the round timber may be prepared in the usual way by soaking in water or by steaming, according to the type of wood, and by chemical additives.

Having thus described the invention, what is claimed as new and desired to be secured by Letters Patent is:

1. A method of removing outer portions of a cylindrical log to form a timber of desired cross-sectional shape from the central portion of the log, said method including the steps of:

advancing said log longitudinally between two opposed banks of staggered knives that are disposed progressively closer to the longitudinal axis of the log in the direction of advance of said log;

engaging said log on opposite sides thereof with said knives;

removing a respective cylinder segment from each of said opposite sides by longitudinally slicing each of said opposite sides with the adjacent bank of knives and forming a plurality of relatively thin sheets each having one end thereof integral with said log; and continuing said slicing step until the full length of said log has passed between said banks and said sheets are separated from said log; and repeating said advancing, engaging and removing steps with successive sets of opposite sides of said log until said timber of said desired cross-sectional shape is formed.

* * * * *